United States Patent [19]

Taniguchi et al.

[11] 4,115,987

[45] Sep. 26, 1978

[54] FRICTION FALSE-TWISTING DEVICE

[75] Inventors: Katsutoshi Taniguchi; Yoji Kuroda, both of Matsuyama, Japan

[73] Assignee: Teijin Limited, Osaka, Japan

[21] Appl. No.: 785,126

[22] Filed: Apr. 6, 1977

[30] Foreign Application Priority Data

Nov. 12, 1976 [JP] Japan ..... 51-135239

[51] Int. Cl.[2] ..... D02G 1/08

[52] U.S. Cl. ..... 57/77.4

[58] Field of Search ..... 57/34 R, 77.3, 77.4

[56] References Cited

U.S. PATENT DOCUMENTS

| | | | |
|---|---|---|---|
| 3,811,258 | 5/1974 | Batsch | 57/77.4 |
| 3,820,317 | 6/1974 | Raschle | 57/77.4 |
| 3,940,914 | 3/1976 | Schuster | 57/77.4 |
| 3,964,248 | 6/1976 | Schuster | 57/77.4 |
| 3,973,383 | 8/1976 | Yu | 57/77.4 |
| 3,973,384 | 8/1976 | Yu | 57/77.4 |
| 4,012,896 | 3/1977 | Eischbach | 57/77.4 |
| 4,018,041 | 4/1977 | Weigert et al. | 57/77.4 |
| 4,051,655 | 10/1977 | Lorenz | 57/77.4 |

*Primary Examiner*—Donald Watkins

*Attorney, Agent, or Firm*—Burgess, Ryan and Wayne

[57] ABSTRACT

Disclosed is a friction false-twisting device comprising three parallel rotatable shafts disposed at vertexes of a regular triangle and a plurality of friction discs having a yarn contacting surface made of ceramic disposed on the rotatable shafts. Each friction disc comprises a pair of parallel end surfaces, having a large distance T(mm) between the end surfaces in a range between 5 and 8 mm, a curved surface disposed at a position between said parallel end surfaces having a large radius of curvature R(mm) in a range between 5 and 8 mm and a pair of connecting surfaces formed between the end surfaces and the curved surface having a small radius of curvature *r*(mm) in a range between 1/6 R and ½ R. The surface roughness of the yarn contacting surface is formed in a range between $1^s$ and $6^s$, defined by Japanese Industrial Standard. The friction discs and the shafts are arranged so that, when utilizing this false-twisting device, yarn can be false-twisted at a speed higher than 400 m/min, yarn breakages and fluffs in the textured yarn are decreased, and the yarn quality of the textured yarn is high and uniform.

7 Claims, 7 Drawing Figures

Fig. 1
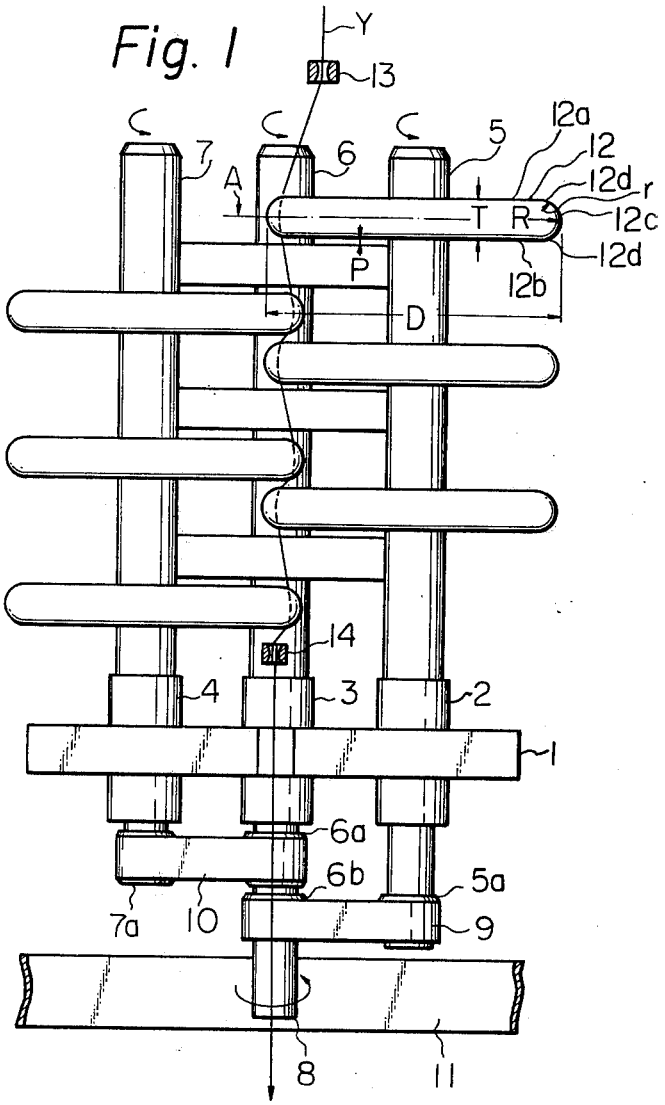
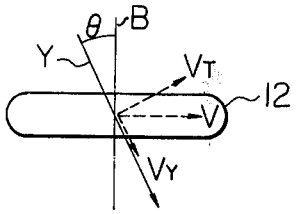
Fig. 2

FRICTION FALSE-TWISTING DEVICE

BACKGROUND OF THE INVENTION

This invention relates to a friction false-twisting device for imparting twists in a yarn running at a high speed.

Many kinds of friction false-twisting devices have been well known. One such false-twisting device comprises three shafts disposed at vertexes of a triangle, respectively, so as to be parallel to each other, and a plurality of friction discs having a yarn contacting surface disposed on the shafts and being supported for sequential positioning. These friction discs lie on a screw-thread and are partially juxtaposed. Such a false-twisting device can not only speed up the texturing speed, but can also facilitate easy threading up operations. Such a device, therefore, is suitable for use in carrying out two false-twisting methods. One of these methods is a draw-false-twist texturing method which comprises a step for drawing undrawn yarn or partially oriented yarn and a step for false-twist texturing the yarn simultaneously with or sequentially to the drawing step. The other method is a spin-draw-false-twist texturing method comprising a step for melt spinning a thermoplastic synthetic yarn and a step for carrying out the above-mentioned draw-false-twist texturing method.

However, when the above-mentioned conventional friction false-twisting device is utilized for false-twist texturing a yarn running at a speed above 400 m/min, defects such as abrasions of the friction discs created by frictional contact with the textured yarn occur. This defect is caused by the material of the contacting surface of the friction disc. That is, since the contacting surface of the conventional false-twisting device is usually made of polyurethane rubber, the durability of the friction disc is low.

A friction false-twisting device having discs with a ceramic coating thereon is also known. However, when the above-mentioned friction false-twisting device is utilized for false-twisting a yarn running at a speed above 400 m/min, although the durability of the friction disc is high enough, the friction disc can not impart sufficient twists to the yarn. As a result, the defect that the yarn quality of the textured yarn is low occurs.

The inventors of the present invention investigated the above-mentioned defects and found that in the conventional friction false-twisting device, having ceramic coated yarn contacting surfaces, the friction disc used does not have a suitable surface roughness and shape for false-twisting a yarn. In addition, it was found that the thickness of the conventional friction disc is too small for false-twisting yarns well. In this regard the inventors found that, when a yarn is friction false-twisted, the shape of the friction disc and the surface condition of the yarn contacting surface of the friction disc are important factors influencing the false-twisting of the yarn. In addition, it was also found that the yarn running angle between the yarn and the rotational axis of the friction disc, which is determined by the arrangement of the friction discs, is an important factor influencing the false-twisting of the yarn.

An object of the present invention is to provide a friction false-twisting device provided with friction discs having high durability.

Another object of the present invention is to provide a friction false-twisting device which can produce a fully and uniformly false-twisted yarn at a high speed above 400 m/min, even at a speed of more than 600 m/min.

A further object of the present invention is to provide a friction false-twisting device provided with discs having a specially designed shape and a specially finished yarn contacting surface.

Other objects of the present invention will be apparent from the following descriptions with reference to the accompanying drawings.

These objects are achieved by a friction false-twisting device comprising three shafts disposed at vertexes of a triangle so as to be parallel to each other and rotatable in the same direction, and a plurality of friction discs having a yarn contacting surface made of ceramic disposed on said shafts, said friction discs being positioned along a screw-thread and being partially juxtaposed, wherein said friction disc comprises, in a combination:

- a pair of end surfaces disposed in parallel having a distance T (mm) between said end surfaces in a range between 5 and 8 mm;
- a curved surface disposed at a position between said end surfaces having a radius of curvature R (mm) in a range between 5 and 8 mm;
- a pair of connecting surfaces disposed at positions between said end surface and said curved surface having a smaller radius curvature *r* (mm) in a range between 1/6 R and ½ R, and;
- a yarn contacting surface comprising said curved surface and a pair of said connecting surfaces having a surface roughness of in a range between $1^s$ and $6^s$.

BRIEF DESCRIPTION OF THE DRAWINGS

FIG. 1 is a side view of the friction false-twisting device according to the present invention;

FIG. 2 is a schematic view for explaining the forces on the yarn running on the friction disc shown in FIG. 1;

DETAILED DESCRIPTION OF THE INVENTION

Figure 3:
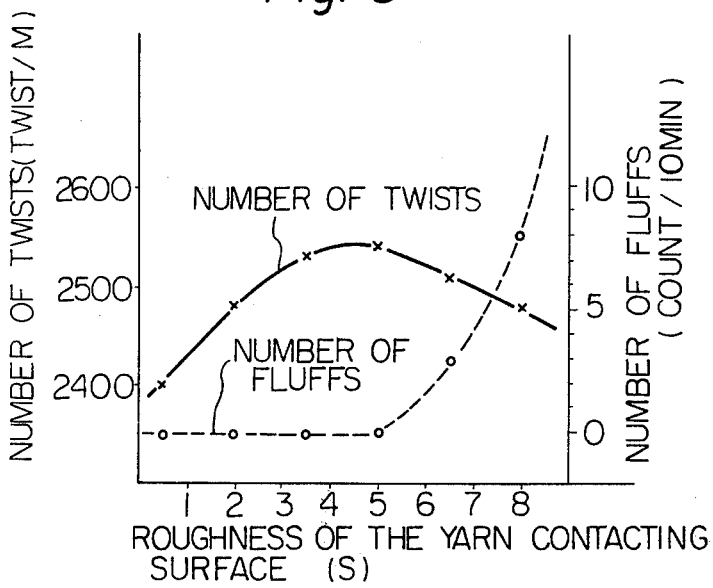
FIG. 3 is a diagram illustrating the relationships between the number of twists, the number of fluffs and the surface roughness of the yarn contacting surface of the friction disc.

The first embodiment of the present invention is hereinafter explained in detail with reference to the accompanying FIG. 1. In FIG. 1, a bracket 1 is provided with three bearings 2, 3 and 4 at positions which are vertexes of a regular triangle (not shown). The bracket 1 has three shafts 5, 6 and 7 rotatably supported thereon via the bearings 2, 3 and 4. The shaft 5 is provided with a pulley 5*a* at a lower portion thereof. The shaft 6 is provided with pulleys 6*a*, 6*b* and driving wheel 8 at a lower portion thereof. The shaft 7 is provided with a pulley 7*a* at a lower portion thereof. A transmitting member such as a toothed belt 9 is belted between the pulleys 5*a* to 6*b*, and a transmitting member such as a toothed belt 10 is belted between the pulleys 6*a* and 7*a*. When the driving wheel 8 is rotated by a driving means such as a driving belt 11, the rotating force is transmitted from the driving wheel 8 to the shaft 6 and to the shafts 5 and 7 via the pulleys 6a to 6b, the toothed belts 9 and 10, and via the pulleys 5a and 7a. As a result, the shafts 5, 6 and 7 are rotated in the same rotating direction.

A plurality of friction discs 12 are disposed on the shafts 5, 6 and 7, and are made of ceramic or of durable material, such as metal having a ceramic coating, thereon. The outer diameter of the friction disc D (mm) is preferably in a range between 40 and 50 mm. Each shaft 5, 6 and 7 is provided with the friction discs in equally spaced apart positions. All the friction discs 12 are placed along a screw thread (not shown) and are partially juxtaposed at their edges 12c. A yarn guide 13 is disposed at a position upstream of the uppermost friction disc 12, and a yarn guide 14 is disposed at a position between 1 and 10 mm downstream of the lowermost friction disc 12 for detwisting tight spots generated in a textured yarn Y.

The friction disc 12 comprises a pair of parallel end surfaces 12a and 12b, and a curved surface 12c between the end surfaces 12a and 12b. The thickness T (mm) of the friction disc 12 between the end surfaces 12a, 12b is in a range between 5 and 8 mm. The radius of curvature R (mm) of the curved surface 12c is in a range between 5 and 8 mm. Connecting surfaces 12d, having a smaller radius of curvature *r* (mm) than the radius of curvature of the curved surface 12c, are disposed at positions between the end surfaces 12a and 12b and the curved surface 12c. The radius of curvature *r* (mm) of the connecting surfaces 12d is in a range between 1/6 R and ½ R, especially in a range between 1/5 R and 2/5 R, so that the yarn Y passes along the smooth surface of the friction discs 12, and fluffs and damage to the yarn are decreased. The friction disc 12 has a shape symmetrical to a plane A centered between the end surfaces 12a and 12b, and parallel to the surfaces 12a and 12b.

With regard to the embodiment shown in FIG. 1, experimental tests were carried out under the following conditions.

A partially oriented yarn (POY) of polyethlene terephthalate filaments, which had been melt-spun at a take-up speed of 3500 m/min, and included $TiO_2$ at 0.5 weight percentage, and had a denier of 225 per 30 filaments (the birefringence $\Delta n$ was 0.051 and the intrinsic viscosity $[\eta]$ was 0.64, as measured in O-chloro-phenol at 35° C.), was drawn and simultaneously false-twisted by the friction false-twisting device shown in FIG. 1. The device was provided with ceramic friction discs having outer diameters D of 50 mm. The texturing speed of the yarn was 450 m/min and the draw ratio was 1.54 so a yarn having denier of 150 was obtained. A heater with a 1.5 m length and maintained at 220° C. was utilized as a twist heat-setting heater. A cooling plate with a 0.5 m length and including water jacket therein was disposed at a position between the heater and the friction false-twisting device. The false-twisted yarn was fed to a take-up with 30% overfeed and was wound around a bobbin to form a cheese. The ratio $S_R/S_Y$ of the outer surface speed $S_R$ of the friction discs and the yarn speed $S_Y$ which imparted the most preferable number of twists to the yarn was determined.

The relationships between the number of twists, the number of fluffs and the surface roughness of the yarn contacting surface of the friction disc obtained by the above-mentioned experimental tests are illustrated in FIG. 3. In FIG. 3, the data related to the number of twists (solid line) and the number of fluffs (broken line) are shown.

Friction discs made of ceramic having a particle diameter of 20μ, a thickness T (mm) of 6.5 mm and a radius of curvature R (mm) of the curved surface of 6 mm were used in these experimental tests.

The surface roughness S was measured by the method of JIS (Japan Industrial Standard) B-0601.

The number of twists was measured by holding both ends of a yarn having a certain length and by counting the number of twists between the held ends with a known twist counter.

The number of fluffs in the textured yarn was measured for 10 minutes by a fray counter manufactured by Toray Industries, Inc.

As indicated in the diagrams of FIG. 3, it was confirmed that it is necessary to provide the yarn contacting surface of the friction disc with a surface roughness in a range between $1^s$ and $6^s$, preferably in a range more than $3^s$ but not more than $6^s$, for preventing the creation of fluffs in the textured yarn and for obtaining a textured yarn having both high strength and elongation. In this regard, it is preferable to make the friction disc of a ceramic having an average particle diameter in a range between 2 and 30μ for obtaining a yarn contacting surface having the above-mentioned smooth surface roughness.

The average diameter of a ceramic particle is measured as follows. After the surface of the friction disc is grounded with diamond particles, a 400 magnification microphoto of the surface of the friction disc is taken through an electron microscope. An inspection area of 15 cm × 15 cm is chosen on the microphoto. Then the area of each of 10 largest ceramic particles $S_1$, $S_2$, . . . $S_{10}$, ($\mu^2$) within the inspection area on the microphoto are measured, and the average area $\bar{S}$ ($\mu^2$) of the 10 areas $S_1$, $S_2$, . . . $S_{10}$ is calculated as follows.

$$\bar{S} = \frac{S_1 + S_2 + \ldots S_{10}}{10}$$

Using the average area $\bar{S}$, the average diameter of the ceramic particle $D_{p(\mu)}$ is calculated as follows.

$$D_p = \sqrt{\frac{\bar{S}}{\pi}} \times \frac{1}{400}$$

wherein $\pi$ is the ratio of the circumference of a circle to its diameter.

The inventors of the present invention conducted an investigation into which shape and surface conditions of the friction disc would improve the twisting ability of the friction false-twisting device. It has been said that the twisting ability of a conventional friction false-twisting device is too low for use in practical mill operations. It has also been said that the increase of a yarn contacting length of the yarn contacting surface causes fluffs in the yarn and yarn breakages. As a result, it has been believed impossible to increase the yarn contacting length so as to increase the twisting ability of the false-twisting device. However, the inventors of the present invention succeeded in decreasing fluffs and yarn breakages by adjusting the surface roughness of the yarn contacting surface of the friction disc made of ceramic in a range between $1^s$ and $6^s$, especially in a range more than $3^s$ but not more than $6^s$.

To increase the effect of the yarn contacting length of the friction disc, many experimental tests were carried out under the same conditions as described above, and the same characteristics were measured by the same methods as described above. In addition, the number of tight spots in the textured yarn were measured by counting the number of tight spots in 20 m length of yarn. The total percentage of crimp TC of the yarn was measured by the method described in the specification of U.S. Pat. No. 3,797,221. The strength and elongation of the yarn were measured by conventional methods.

The results obtained from the above-mentioned tests are shown in the following Table.

Table

| | Construction of False-Twisting Device | | | | | | |
|---|---|---|---|---|---|---|---|
| Identification No. of Test | Thickness of friction Disc T(mm) | Radius of curvature of curved surface R(mm) | R/T | Radius of curvature of curved surface r(mm) | Clearance between the friction Discs P(mm) | tanθ | Roughness of yarn contacting surface (S) |
| 1 | 5 | 5 | 1 | 2 | 1.0 | 0.29 | 3.5 |
| 2 | 8 | 6 | 3/4 | 2 | 1.0 | 0.29 | 3.5 |
| 3 | 6.5 | 5 | 10/13 | 2 | 1.0 | 0.29 | 3.5 |
| 4 | 6.5 | 6.5 | 1 | 2 | 1.0 | 0.29 | 3.5 |
| 5 | 6.5 | 6 | 12/13 | 1 | 1.0 | 0.29 | 2.5 |
| 6 | 6.5 | 6 | 12/13 | 2 | 1.0 | 0.29 | 3.5 |
| 7 | 6.5 | 6 | 12/13 | 2 | 0.5 | 0.37 | 3.5 |
| 8 | 6.5 | 6 | 12/13 | 2 | 2.0 | 0.31 | 3.5 |
| 9 | 6.5 | 6 | 12/13 | 2 | 1.0 | 0.29 | 5.0 |
| 10 | 6.5 | 6 | 12/13 | 2 | 1.0 | 0.29 | 2 |
| 11 | 3 | 4 | 3/4 | 2 | 1.0 | 0.29 | 3 |
| 12 | 6.5 | 3.25 | 1/2 | 2 | 1.0 | 0.29 | 3 |
| 13 | 6.5 | 6 | 12/13 | 7 | 1.0 | 0.29 | 3 |
| 14 | 6.5 | 6 | 12/13 | 6 | 1.0 | 0.29 | 3 |
| 15 | 6.5 | 6 | 12/13 | 2 | 1.0 | 0.29 | 8 |

| | | Quality of Textured Yarn | | | | |
|---|---|---|---|---|---|---|
| Identification No. of Test | Number of twists (Twists/m) | Number of fluffs (count/10MN) | Tight spots (count/20M) | Total percentage of crimp TC(%) | Strength (g/de) | Elongation (%) |
| 1 | 2510 | 0 | 0 | 31 | 3.8 | 26 |
| 2 | 2500 | 0 | 0 | 30 | 3.8 | 26 |
| 3 | 2550 | 0 | 0 | 38 | 3.7 | 25 |
| 4 | 2550 | 0 | 0 | 38 | 3.7 | 25 |
| 5 | 2530 | 0 | 0 | 34 | 3.6 | 24 |
| 6 | 2550 | 0 | 0 | 38 | 4.0 | 26 |
| 7 | 2500 | 0 | 2 | 30 | 3.8 | 26 |
| 8 | 2540 | 2 | 0 | 34 | 3.6 | 24 |
| 9 | 2540 | 0 | 0 | 30 | 4.0 | 26 |
| 10 | 2480 | 0 | 0 | 30 | 4.0 | 26 |
| 11 | 2200 | 0 | 0 | 21 | 3.8 | 26 |
| 12 | 2400 | 1 | 0 | 23 | 3.9 | 25 |
| 13 | 2480 | 10 | 0 | 29 | 2.9 | 18 |
| 14 | 2500 | 7 | 0 | 30 | 3.1 | 21 |
| 15 | 2480 | 7 | 0 | 29 | 2.9 | 19 |

In the above table, test cases 1 through 10 are examples of this invention and test cases 11 through 15 are comparisons.

During the experimental tests, it was observed that, when the thickness T (mm) of the friction disc is less than 5 mm, twists are not fully imparted to the yarn and a problem of a decrease in the total percentage of crimp (crimpability) TC of the obtained yarn occurs. It was also found that, when the thickness T (mm) of the friction disc is more than 8 mm, and excessive yarn resistance along the yarn path is generated on the running yarn. This excessive resistance not only causes yarn breakages and fluffs, but also yarn path variations, which results in the total percentage of crimp (crimpability) TC of the yarn being decreased. It was confirmed that the thickness of the friction disc must be in a range between 5 and 8 mm for imparting suitable twists into the yarn and for preventing a decrease of the twisting ability caused by the yarn path variations at the curved surface of the friction disc.

Figure 4:
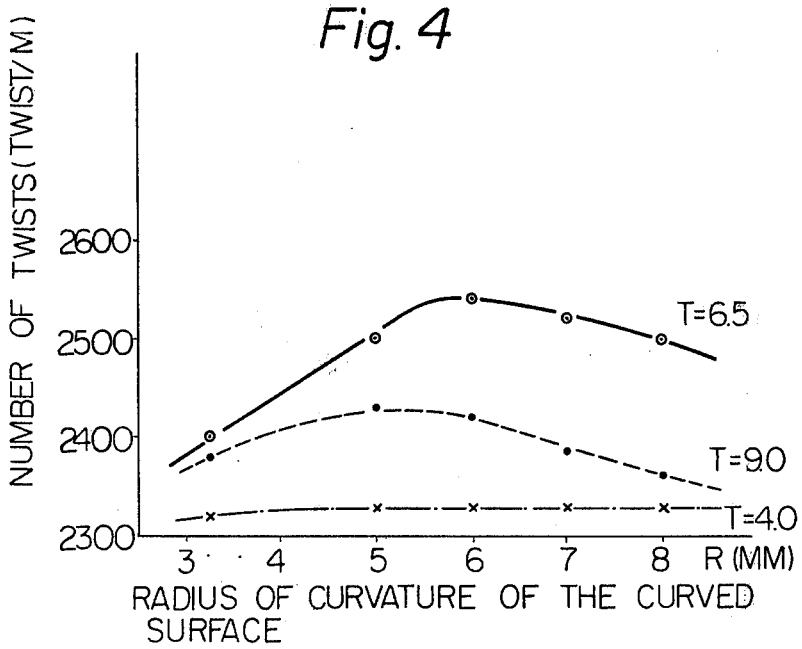
FIG. 4 is a diagram illustrating the relationships between the number of twists and the radius of curvature of the curved surface of the friction disc.

The effect of the radius of curvature R (mm) of the curved surface of the friction disc is hereinafter explained with reference to the accompanying FIG. 4. In FIG. 4, the relationships between the number of twists and the radius of curvature R (mm) of the curved surface are shown for the friction discs having thicknesses T (mm) of 6.5 mm (solid line), 9.0 mm (broken line) and 4.0 mm (dot-dash line). It is generally known that the number of twists involved in a yarn having good twisting ability is at least $2450^{TWISTS}/M$ for a polyester yarn having denier of 150. Therefore, the tested case, yarns having more than $2500^{TWISTS}/M$ were fully imparted twists. Referring to FIG. 4, friction discs having thicknesses within the range of the present invention can fully impart twists into the yarn. The twisting ability of the friction discs having a thickness T within the range of the present invention varies with changes in the radius of curvature R. The inventors of the present invention think that the phenomena is caused by the fact that, when the radius of curvature R (mm) of the curved surface is larger than that according to the present invention, the curved surface becomes similar to a cylindrical surface and has edges at portions connecting the curved surface to end surfaces of the friction disc. As a result, the yarn is twisted only by the edge, the twists can not be fully imparted to the yarn and uneveness of the twists may occur. When the radius of curvature R (mm) is less than that of the present invention, the differences of the rotating speeds between the connecting surfaces and the outer portion of the curved surface become large. As a result, different twists are imparted to the yarn along the yarn path, and uneveness and a decrease in the number of twists can occur. It was confirmed that the radius of curvature R (mm) of the curved surface must be in a range between 5 and 8 mm.

According to various tests, it was found preferable that the ratio R/T of the radius of curvature R (mm) of the curved surface and the thickness T (mm) of the friction disc is in a range between $\frac{3}{4}$ and 1.

The clearance P (mm) (FIG. 1) between the adjacent friction discs is in a range between 0.5 and 2.0 mm. When the clearance P (mm) exceeds 2.0 mm, fluffs may be generated on the yarn. When the clearance P (mm) is less then 0.5 mm, it is very difficult to thread the yarn through the clearance.

In the equation $$\frac{\frac{\sqrt{3}}{2}D - L}{2(T+P)} : T\text{ (mm) and } D\text{ (mm)}$$

are the thickness and outer diameter of the friction disc 12, respectively; L (mm) is the distance between the shafts 5, 6 and 7, and; P (mm) is the clearance between the adjacent discs 12. It is preferable that the value of $$\frac{\frac{\sqrt{3}}{2}D - L}{2(T+P)}$$

be in a range between 0.23 and 0.45, especially in a range between 0.26 and 0.36.

The value $$\frac{\frac{\sqrt{3}}{2}D - L}{2(T+P)}$$

is a tangent of the angle $\theta$ (tan $\theta$ ) formed between the running yarn Y and the rotational axis B of the friction disc 12 as shown in FIG. 2. While the yarn Y passes along the smooth surface of the friction disc 12 and is frictionally false-twisted, a frictional twisting force V is caused on the yarn Y by the rotating friction disc 12. The frictional twisting force V is decomposed into an element $V_T$ in a direction perpendicular to the yarn Y (twisting force) and an element $V_Y$ in a direction along the yarn Y (yarn delivery force). It is very important to adjust the balance between the twisting force $V_T$ and yarn delivery force $V_Y$ to impart stuitable twists into the yarn.

With a conventional false-twisting method, it was very difficult to adjust the above-mentioned balance. When the balance is not adjusted less false-twisting and uneveness of twisting occur in the textured yarn. Especially with the conventional friction discs having a yarn contacting surface of ceramic coating, the balance could not adjusted, and it was difficult to impart sufficient twists to the yarn and to obtain a textured yarn of high quality.

According to the present invention, when tan $\theta$ is in the above-mentioned range between 0.23 and 0.45, the balance can be easily adjusted and a textured yarn of high quality can be obtained. When tan $\theta$ is less than 0.23, fluffs and yarn breakages may occur frequently. When tan $\theta$ is more than 0.45, tight spots in the textured yarn may increase and the crimpability of the yarn may be decreased. If tan $\theta$ is in a range between 0.26 and 0.36, it becomes easier to texture the yarn and the crimpability of the textured yarn becomes high.

As mentioned above, the yarn is passed via the yarn guide 13 and contacts each friction disc 12 at a wedge portion formed between adjacent juxtaposed discs 12. In the present invention, since the friction disc 12 has a sufficiently large thickness T (mm) and a sufficiently large radius of curvature R (mm) at the curved surface, the difference in the rotating speeds on the friction disc between the connecting surfaces and a portion where the yarn is imparted twists with the highest twisting speed is kept low so that the yarn can be almost uniformly twisted along the yarn path at an almost uniform twisting speed. The yarn is fully twisted because the thickness of the friction disc is large enough for imparting sufficient twisting. In addition, be arranging the friction discs and shafts in a certain way, the twisting force and the yarn delivery force imparted by the friction disc can be adjusted so that they are balanced. Consequently, uniform and sufficient twists can be imparted to the yarn and a textured yarn having uniform quality can be obtained. In addition the yarn can be false twisted at a speed higher than 400 m/min, even at a speed higher than 600 m/min.

Figure 5:
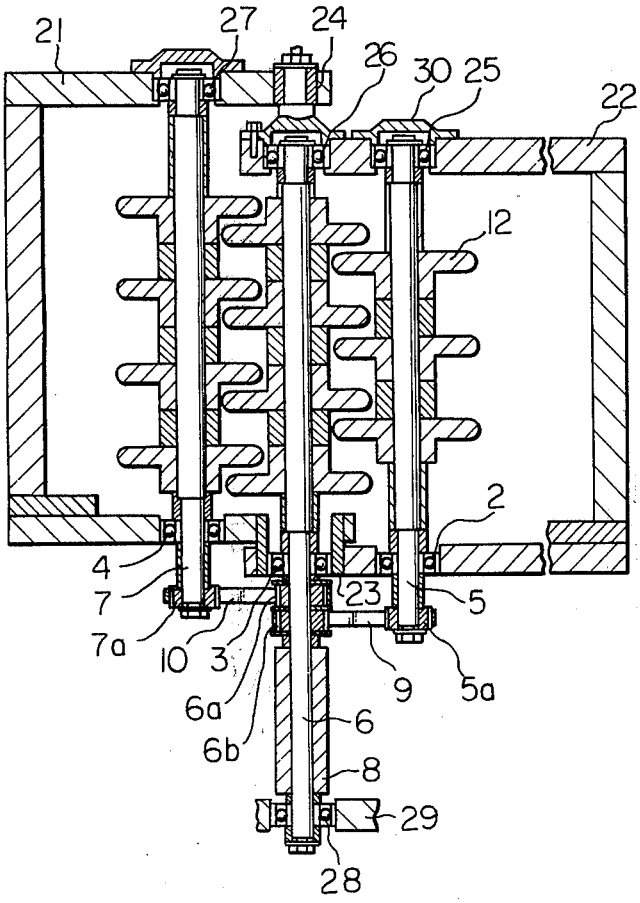
FIG. 5 is a cross-sectional side view of another embodiment according to the present invention, sectioned along line V—V in FIG. 6 and FIG. 7.
Figure 6:
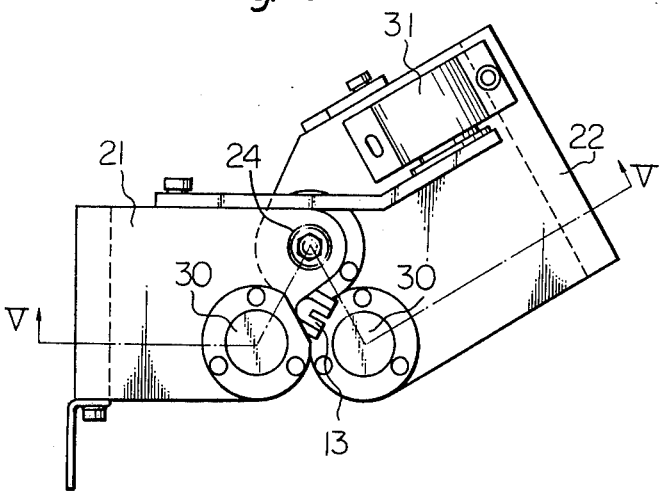
FIGS. 6 and 7 are plan views of the device shown in FIG. 5.
Figure 7:
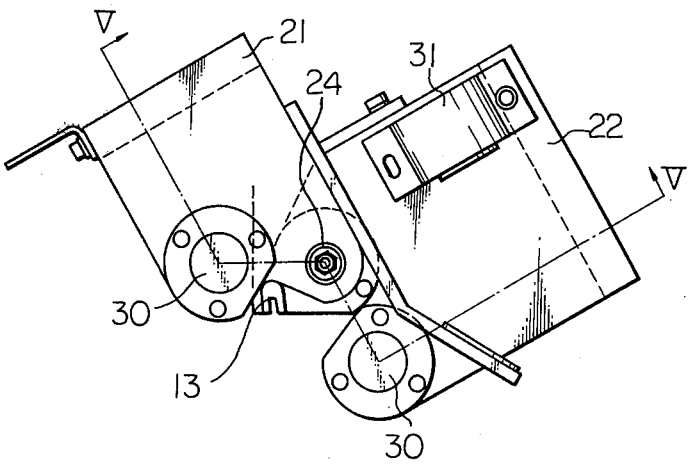

Another embodiment according to the present invention is hereinafter explained with reference to accompanying FIGS. 5 through 7. The device of this embodiment is very similar to the device shown in FIG. 1, except for the following. The device shown in FIG. 5 has a pair of C-shaped brackets 21, 22, the shafts 5, 6, 7 are provided with bearings 2, 3, 4 at one end and 25, 26, 27 at the other end, respectively, and the C-shaped bracket 22 is pivotably mounted via bearing bushes 23, 24 so as to be capable of being swung as shown in FIG. 6 for normal operation and as shown in FIG. 7 for threading up the device. In FIG. 5 the same parts as shown in FIG. 1 are designated with the same reference numerals as used in FIG. 1. A bearing 28 is utilized for fixing the device to a machine frame 29. Covers 30 are utilized for preventing dust from entering into the bearings 25, 26 and 27. A magnet 31 is utilized for securing the bracket 22 at a predetermined position during the false-twisting operation.

This embodiment can decrease oscillation of the friction discs 12, because the two ends of the shaft 5, 6 or 7, to which the discs 12 are fixed, are supported by the bearings 2 and 25, 3 and 26 or 4 and 27, respectively. Therefore the yarn path variation caused by the oscillation of the friction discs 12 can be lowered.

What we claim is:

1. A friction false-twisting device comprising three shafts disposed at vertexes of a triangle so as to be parallel to each other and rotatable in the same direction, and a plurality of friction discs each having a yarn contacting surface made of ceramic disposed on each of said shafts, said friction discs being positioned along a screw-thread and being partially juxtaposed, wherein each said friction disc comprises:

a pair of end surfaces disposed in parallel having a distance T (mm) between said end surfaces in a range between 5 and 8 mm, and said disc having a shape symmetrical with respect to a plane centrally situated between said end surfaces and parallel to said end surfaces;

a curved edge surface disposed at a position between said end surfaces having a radius of curvature R (mm) in a range between 5 and 8 mm;

a pair of connecting surfaces disposed at positions between said end surfaces and said curved surface having a smaller radius of curvature $r$ (mm) in a range between 1/5 R and 2/5 R; and a yarn contacting surface comprising said curved surface and a pair of said connecting surfaces having a surface roughness in a range between $1^s$ and $6^s$, said yarn contacting surface (i) comprising ceramic material having an average particle diameter in a range between 2 and 30$\mu$ and (ii) being free of any tracks thereon oriented in any predetermined direction.

2. A friction false-twisting device according to claim 1, wherein the ratio R/T of said radius of curvature R (mm) of said curved surface and said distance T (mm) formed between said end surfaces is in a range between $\frac{3}{4}$ and 1.

3. A friction false-twisting device according to claim 1, wherein the value $$\frac{\frac{\sqrt{3}}{2}D - L}{2(T+P)}$$

is in a range between 0.23 and 0.45, wherein $D$ is the outer diameter of said friction disc (mm), $L$ is the distance between said shafts (mm), $T$ is the thickness of said friction disc (mm) and, $P$ is the clearance between said adjacent friction discs (mm).

4. A friction false-twisting device according to claim 3, wherein the value $$\frac{\frac{\sqrt{3}}{2}D - L}{2(T+P)}$$

is in a range between 0.26 and 0.36.

5. A friction false-twisting device according to claim 1, wherein said surface roughness of said contacting surface is in a range of more than $3^s$ but not more than $6^s$.

6. A friction false-twisting device according to claim 1, wherein each said shaft is provided with a bearing at each end thereof.

7. A friction false-twisting device according to claim 1, further comprising a yarn guide disposed at a position between 1 and 10 mm downstream from the final friction disc.

* * * * *

UNITED STATES PATENT OFFICE
CERTIFICATE OF CORRECTION

Patent No. 4,115,987 Dated September 26, 1978

Inventor(s) Katsutoshi Taniguchi, et al

It is certified that error appears in the above-identified patent and that said Letters Patent are hereby corrected as shown below:

Column 3, line 42: "polyethlene" should be --polyethylene--.

Column 5, under Table "Quality of Textured Yarn", under "TC(%)", 9th line down: "30" should be --38--.

Column 7, line 52: "stuitable" should be --suitable--.

Column 9, line 19: "2" should be --2 μ--.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*